United States Patent [19]

Drall

[11] 4,407,554

[45] Oct. 4, 1983

[54] ELECTRICAL PLUG SAFETY DEVICE

[76] Inventor: Jerry E. Drall, 5167 Patrick Dr., West Bloomfield, Mich. 48033

[21] Appl. No.: 244,512

[22] Filed: Mar. 16, 1981

[51] Int. Cl.[3] ..... H01R 13/44

[52] U.S. Cl. ..... 339/37

[58] Field of Search ..... 339/36, 37

[56] References Cited

U.S. PATENT DOCUMENTS

| | | | |
|---|---|---|---|
| 3,345,600 | 10/1967 | Scherer . | |
| 3,416,123 | 12/1968 | Husebo . | |
| 3,422,389 | 1/1969 | Husebo . | |
| 3,539,968 | 11/1970 | Tunstall et al. . | |
| 3,662,320 | 5/1972 | Marx . | |
| 3,781,913 | 12/1973 | Liburdi . | |
| 4,204,723 | 5/1980 | Bloomingdale | 339/36 |

*Primary Examiner*—Mark Rosenbaum

*Attorney, Agent, or Firm*—Brooks & Kushman

[57] ABSTRACT

An electrical plug safety device (10) disclosed comprises a clasp including an elongated pin (20) having an electrically nonconductive outer surface. A distal end (24) of the pin (20) is inserted through prong openings of an electrical plug in an open position whereupon movement of the pin to a closed position secures the plug against use. A connector (26) of the clasp has one end (28) that supports an attached end (22) of the pin and another end including a retainer (32) that receives the distal end of the pin in the closed position. An opening (34) of the retainer (32) is capable of receiving a lock shackle to thereby control use of the plug. The clasp is preferably made as a bent elongated metal wire (40) that has an electrical nonconductive outer cover (42).

4 Claims, 3 Drawing Figures

ELECTRICAL PLUG SAFETY DEVICE

TECHNICAL FIELD

This invention relates to an electrical plug safety device of the type secured within the prong openings of an electrical plug.

BACKGROUND ART

Prior art safety devices have included pins or the like that are inserted through prong openings of an electrical plug such that adults can prevent children from receiving an electrical shock upon playing with the plug or from operating an electrical tool or appliance, etc. connected to the plug. Such prior art devices have required either a special tool or lock to secure the device to the plug.

U.S. Pat. Nos. 3,416,123 and 3,422,389 each disclose a plug block that defines holes for receiving the plug prongs. A cross bore of the block receives a pin that is inserted through the prong openings to secure the plug to the block. A lock associated with the block selectively secures the pin so as to retain the block on the plug in order to control use of the plug.

U.S. Pat. Nos. 3,345,600; 3,539,968; and 3,662,342 disclose electrical plug safety devices including brackets or housings that are stamped from sheet metal and secured through prong openings of an associated electrical plug in cooperation with the shackle of a lock. None of these devices has a construction that is both economical to manufacture as well as easy to use. For example, the 3,345,600 patent discloses an electrical plug locking device that is manufactured with a pivotal pin located between spaced legs of a stamped sheet metal housing. During use, the pin must be pivoted to an outwardly projecting position and then inserted through the prong openings of an associated plug whereupon the plug prongs are inserted into the housing so as to pivot the pin such that it can be secured by a lock. Such a device thus requires a relatively involved manual manipulation to retain the device to the plug. Likewise, the 3,539,968 patent discloses a two-piece device including a strap and an associated pin that are locked together with the pin extending through both the strap and the associated plug prong openings to secure the device to the plug, the problem with such a device being that the pin and the strap can become separated when not being used and either is thus easily lost. The safety device disclosed by the 3,662,320 patent includes a stamped metal slide assembly having two pieces whose construction is not particularly easy to manufacture so as to be capable of assembly in a sliding manner that locks the device through the prong openings of an associated electrical plug in cooperation with a lock.

U.S. Pat. No. 3,781,913 discloses a device that requires a screwdriver to secure a screw through a plug prong opening to a safety block in order to prevent use of the plug.

Also, small locks have previously been secured with the shackle thereof extending through one prong opening of an electrical plug.

DISCLOSURE OF INVENTION

An object of the present invention is to provide an improved electrical plug safety device that is economical to manufacture and easy to use as well as effective in performance.

In carrying out the above object, an electrical plug safety device constructed in accordance with the invention comprises a clasp including an elongated pin having an electrically nonconductive outer surface. The pin includes an attached end as well as a distal end that can be inserted through the prong openings of an electrical plug. An elongated connector of the clasp has one end that supports the attached end of the pin for movement of the pin between open and closed positions. Another end of the connector includes a retainer formed to receive the distal end of the pin in the closed position thereof so as to prevent use of an electrical plug with the pin extending through the prong openings of the plug. Movement of the pin to the open position free from the retainer allows withdrawal of the pin from the prong openings such that the plug can be used. The retainer has an opening capable of receiving a shackle of a lock to prevent movement of the pin to the open position and thereby selectively ensures nonuse of the plug under control of the lock.

Such a safety device can be used with or without an associated lock of either the key or combination type. Use of the device even without a lock will prevent young children lacking the requisite manual strength to open the clasp from playing with the plug and possibly receiving an electrical shock. Use of the device with a lock will prevent even older children from opening the clasp and playing with the plug such that an electrical shock is possible and will also control use of the electrical apparatus connected to the plug. In either case, the electrically nonconductive outer surface of the pin prevents an electrical short across the prongs by a partial insertion of the prongs into an electrical outlet with the clasp pin projecting through the prong openings.

In the preferred construction of the safety device, the clasp comprises an elongated metal wire that is bent to define the pin, the connector, and the retainer. The wire has an electrically nonconductive outer cover along its entire length such that the connector as well as the pin cannot short the prongs upon partial insertion thereof into an outlet. Also, the retainer preferably comprises an offset loop into which the wire is bent in order to receive the distal end of the pin in the closed position and to also define the opening that receives a lock shackle for engaging the pin to prevent movement of the pin to its open position.

With the covered bent wire construction of this clasp safety device, the connector deflectably supports the attached end of the pin for its movement between open and closed positions. In the closed position the offset loop of the retainer receives the distal end of the pin and is also capable of receiving a shackle of a lock to prevent movement of the pin to the open position and thereby selectively ensures nonuse of the plug under control of the lock. Use of spring steel for the wire provides the pin with a sufficient bias of its distal end into engagement with the retainer loop such that even older children will not be able to open the clasp.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
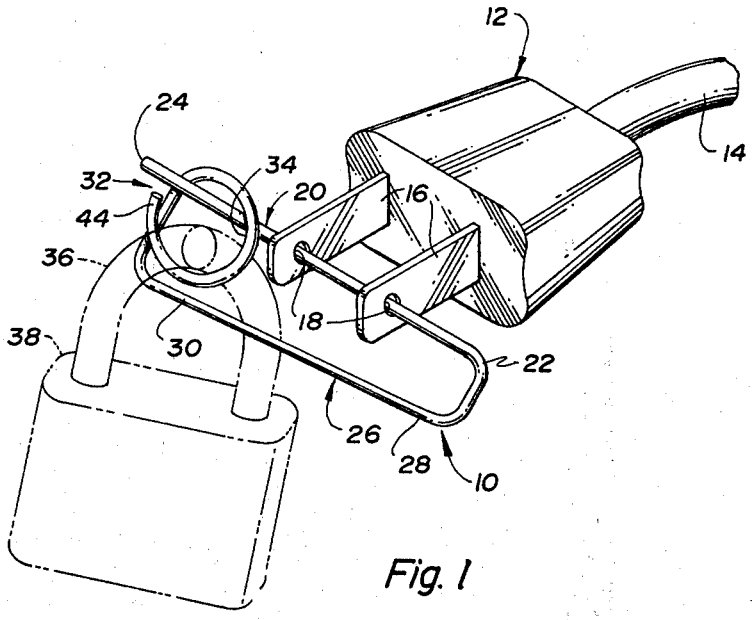
FIG. 1 is a perspective view of a safety device constructed in accordance with the present invention and illustrated with a clasp thereof in a closed position secured to an electrical plug.

Referring to FIG. 1 of the drawings, a safety device constructed in accordance with the present invention is generally indicated by reference numeral 10 and is used with an electrical plug 12 to prevent children from receiving an electrical shock upon playing with the plug and to also selectively prevent use of electrical apparatus of whatever type connected to the plug cord 14. As is more fully hereinafter described, the safety device 10 is secured to the prongs 16 of plug 10 through the associated openings 18 thereof in order to prevent the prongs from being inserted into an electrical outlet. Although the safety device 10 is illustrated with an ungrounded plug 12, it can also be utilized with a grounded plug including a third grounding prong located between the two prongs 16 to one side or the other.

As seen in both FIGS. 1 and 2, the safety device 10 comprises a clasp including an elongated pin 20 which, as is hereinafter described, has an electrically nonconductive outer surface. Pin 20 of the clasp includes an attached end 22 as well as a distal end 24 that can be inserted through the prong openings 18 of the electrical plug 12. The clasp device 10 also includes a connector 26 having one end 28 that supports the attached end 22 of the pin 20 for movement of the pin between the closed position shown in FIG. 1 and the open position shown in FIG. 2. Another end 30 of the clasp connector 26 includes a retainer 32 that is formed to receive the distal end 24 of pin 20 in the closed position. The pin 20 is movable to the open position free from the retainer 32 to allow withdrawal of the pin from the prong openings 18 such that the plug 12 can be used. Insertion of the pin 20 through the prong openings 18 is also performed with the clasp in this open position. The retainer 32 has an opening 34 capable of receiving a shackle 36 of a lock 38 so as to prevent movement of the pin 20 from the closed position to the open position in order to selectively ensure nonuse of the plug under the control of the lock.

Figure 2:
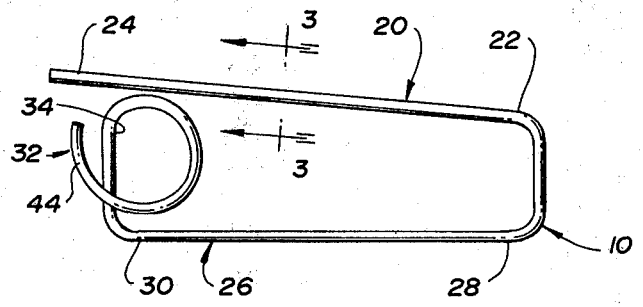
FIG. 2 is a perspective view illustrating the clasp in an open position removed from the electrical plug.

The clasp safety device 10 shown in FIGS. 1 and 2 can be used with or without the lock 38. Use without the lock prevents small children without sufficient manual dexterity or strength from opening the clasp and possibly receiving a shock or operating the electrical apparatus connected to the plug cord. Use with the lock 38 which may be either of the key or combination type prevents older children from receiving an electrical shock or operating the electrical apparatus connected to the plug cord. In either case, the nonconductive outer surface of the plug pin 20 prevents electrical shorting of the plug by a partial insertion of the plug prongs 16 into an electrical outlet.

Figure 3:
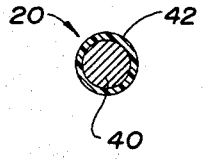
FIG. 3 is a cross sectional view taken through a pin of the clasp along line 3—3 of FIG. 2.

As illustrated in FIG. 3, the clasp safety device preferably comprises an elongated metal wire 40 that is bent to define the pin 20, the connector 26, and the retainer 32. Bent wire 40 has an outer cover 42 that is electrically nonconductive such that a short cannot be established along the pin 20 with the prongs 16 partially inserted into an electrical outlet. Likewise, the connector 20 is also nonconductive so that pivoting of the device to engage the connector with the prongs 16 adjacent the inner ends thereof will likewise not produce any electrical short with the prongs partially inserted into an electrical outlet.

The retainer 32 of the clasp safety device is preferably provided by an offset loop 44 into which the wire is bent. Loop 44 defines the retainer opening 34 that receives the distal end 24 of the pin 20 and the lock shackle 38 whose engagement with the distal pin end prevents movement of the pin to its open position. The extreme end of the wire at the loop 44 is offset from the adjacent wire portion sufficiently so that the distal pin end 24 can move therebetween for movement between the open and closed positions.

With the preferred covered bent wire construction of the clasp safety device, the connector 26 deflectably supports the attached end 22 of pin 20 for movement between its closed position shown in FIG. 1 and its open position shown in FIG. 2. The wire utilized is preferably made from spring steel and bent to an undeflected free position corresponding to the open position of the clasp such that the closed clasp will be biased so that its distal end 24 is maintained in a secured relationship within the offset loop 44 by the bias of the clasp.

While the best mode for carrying out the invention has been described in detail, those familiar with the art to which this invention relates will recognize various alternative designs and embodiments for practicing the invention as defined by the following claims.

What is claimed is:

1. An electrical plug safety device for use with an electrical plug having prongs including openings, the safety device comprising: a clasp including an elongated pin having an electrically nonconductive outer surface; said pin including an attached end and a distal end that can be inserted through the prong openings of the electrical plug; said clasp also including an elongated connector having one end that supports the attached end of the pin for movement of the pin between open and closed positions; said connector also having another end including a retainer formed to receive the distal end of the pin in the closed position thereof so as to prevent use of the electrical plug with the pin extending through the prong openings thereof; said pin being movable to the open position free from the retainer to allow withdrawal thereof from the prong openings such that the plug can be used; and said retainer having an opening capable of receiving a shackle of a lock to prevent movement of the pin to the open position and thereby selectively ensuring nonuse of the plug under control of the lock.

2. A safety device as in claim 1 wherein the clasp comprises an elongated metal wire that is bent to define the pin, the connector, and the retainer; and said wire having an electrically nonconductive outer cover.

3. A safety device as in claim 2 wherein the retainer comprises an offset loop into which the wire is bent.

4. An electrical plug safety device for use with an electrical plug having prongs including openings, the safety device comprising: a clasp bent from an elongated metal wire having an electrically nonconductive outer cover; said wire including an elongated pin including an attached end and a distal end that can be inserted through the prong openings of the electrical plug; said wire also including an elongated connector having one end that deflectably supports the attached end of the pin for movement of the pin between open and closed positions; said connector also having another end including a retainer; said retainer including an offset loop into which the wire is bent to receive the distal end of the pin in the closed position thereof so as to prevent use of the electrical plug with the pin extending through the prong openings thereof; said pin being movable to the open position free from the offset loop of the retainer to allow withdrawal thereof from the prong openings such that the plug can be used; and said offset loop of the retainer having an opening capable of receiving a shackle of a lock to prevent movement of the pin to the open position and thereby selectively ensuring nonuse of the plug under control of the lock.

* * * * *